United States Patent [19]

Ponte

[11] Patent Number: 4,480,564

[45] Date of Patent: Nov. 6, 1984

[54] BUTTON LOCATING CLAMP FOR SEWING MACHINES

[75] Inventor: Gary W. Ponte, Passaic, N.J.

[73] Assignee: The Singer Company, Stamford, Conn.

[21] Appl. No.: 488,898

[22] Filed: Apr. 27, 1983

[51] Int. Cl.[3] ..... D05B 3/16; D05B 29/00; D05B 97/10

[52] U.S. Cl. ..... 112/237; 112/112

[58] Field of Search ..... 112/110, 111, 112, 169, 112/235, 237

[56] References Cited

U.S. PATENT DOCUMENTS

| | | | |
|---|---|---|---|
| 649,871 | 5/1900 | Merritt | 112/112 |
| 712,191 | 10/1902 | Hogan | 112/112 X |
| 2,513,633 | 7/1950 | Folsom | 112/110 X |
| 2,942,565 | 6/1960 | Johnson | 112/235 |
| 3,143,092 | 8/1964 | Glassman et al. | 112/235 X |
| 3,165,080 | 1/1965 | Castelletti | 112/112 |
| 3,356,053 | 12/1967 | Potvin | 112/235 |
| 4,069,779 | 1/1978 | Klein | 112/136 |
| 4,197,803 | 4/1980 | Marsh | 112/235 X |

FOREIGN PATENT DOCUMENTS

| | | | |
|---|---|---|---|
| 364975 | 11/1962 | Switzerland | 112/235 |

*Primary Examiner*—Wm. Carter Reynolds

*Attorney, Agent, or Firm*—Robert E. Smith; Edward L. Bell

[57] ABSTRACT

A work holding clamp for a four hole button sewing machine includes a button holding foot formed with a needle accommodating aperture having an hourglass shape with four recesses arranged at the corners of a square pattern graphically to indicate to an operator the proper hole orientation.

1 Claim, 3 Drawing Figures

BUTTON LOCATING CLAMP FOR SEWING MACHINES

BACKGROUND OF THE INVENTION

Button sewing mechanisms with the capability of so shifting a four hole button as to result in the formation of separate stitch tacks between different pairs of holes in the button have heretofore been mainly industrial sewing machines intended for use by trained operators. Visual indication of proper button orientation is not found on industrial button sewing machines, probably for the same reason that the notes are not indicated on the keys of a concert piano.

A four hole button sewing machine designed for household use by an operator who is unfamiliar with the machine operation and uses the machine infrequently, presents a problem in that proper button orientation is not inherently self-evident and improper orientation can result in damage to the work and to the stitching mechanism and in the event of needle breakage might even inflict injury to the operator.

SUMMARY OF THE INVENTION

It is an object of this invention to provide a button supporting clamp for a four hole button sewing machine which is formed in a novel manner visually to indicate to the machine operator the proper button orientation with the four holes of the button properly arranged to accommodate two successive different stitch tacks each tack in a different pair of the holes of the button.

DESCRIPTION OF THE DRAWING

With the above and additional objects and advantages in view as will hereinafter appear, this invention will now be described with reference to a preferred embodiment illustrated in the accompanying drawing in which.

DESCRIPTION OF THE INVENTION

This invention has particular utility in association with a four hole button sewing machine designed for household use. Reference is made to my copending U.S. patent application Ser. No. 488,904, filed Apr. 27, 1983, disclosing a hand held four hole button sewing machine for household use which is incorporated herein by reference.

Figure 1:
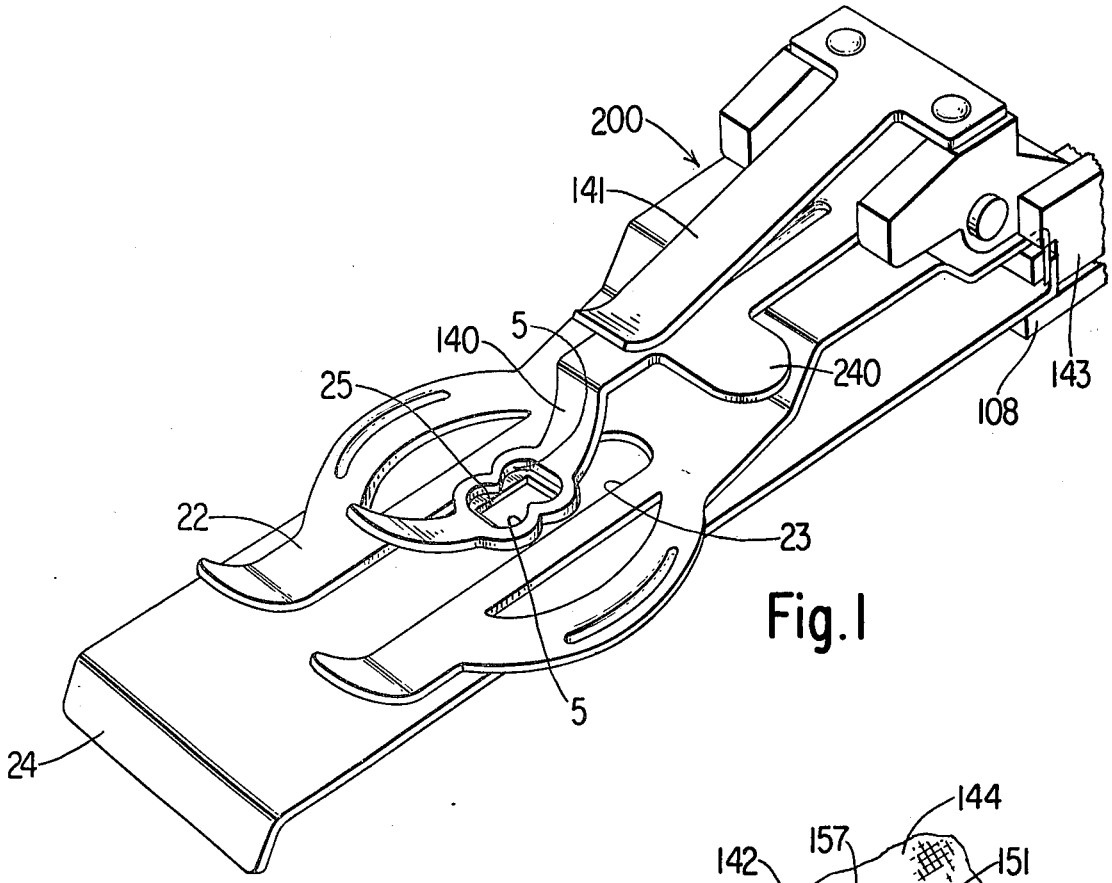
FIG. 1 is a perspective view of a portion of a button holding work clamp of a four hole button sewing machine having this invention applied thereto.

The work fabric and button holding clamp unit of the referenced U.S. patent application Ser. No. 488,904, is illustrated in FIG. 1 herein and is designated generally at 200.

Figure 3:
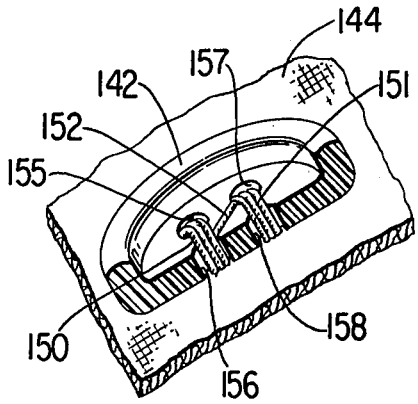
FIG. 3 is a perspective view of a four hole button illustrating the securing stitches therefor as provided by operation of a sewing machine with which this invention has utility.

The clamp 200 comprises a lower fabric jaw 24 with a needle accommodating aperture 25 which is arranged in opposition to an upper fabric jaw 22 formed with a needle accommodating slot 23. The jaws 22 and 24 are secured to a mounting block 143 and extend therefrom in predetermined superposed position preferrably resiliently biased toward each other so as to clamp and hold a fabric such as that indicated at 144 in FIG. 3 when it is inserted between the jaws.

Also secured to the mounting block 143 and extending therefrom to a position over the jaws 22 and 24, is a button holding foot 140. The foot 140 may, itself, comprise a leaf spring biased downwardly against the jaw 22 and, in addition, an auxiliary leaf spring 141 may be secured to the mounting block and arranged to bear against the button holding foot to assist in urging the foot downwardly against the jaws 22 and 24. A lateral finger grip 240 on the foot 140 may be grasped by the machine operator to lift the foot as for inserting or withdrawing a button 142 between the foot 140 and the upper fabric jaw 22.

It will be understood that the jaws 22 and 24 together with the button holding foot 140 form, with the mounting block 143, the integral clamp unit 200 and are shiftably supported for movement as a unit together with a clamp carrier member 108 in the stitch-by-stitch lateral jogging movements of the clamp carrier member and for movement lengthwise relatively to the clamp carrier member 108, all as described in detail in the above referenced U.S. patent application, In moving laterally with the clamp carrier member 108, the fabric and button holding clamp will move so as to produce a zig zag tack of stitches 150 between two holes 155 and 156 of a four hole button 142 and in moving lengthwise relatively to the clamp carrier member 108 the fabric and button holding clamp will shift the button and fabric to a new location such that further lateral movement with the clamp carrier member 108 will produce a second zig zag stitch tack 151 between the other two holes 157 and 158 of the button with a single crossover stitch 152 between the two tacks 150 and 151.

For assisting the proper orientation of a four hole button 142 beneath the button holding foot 140, the foot 140 is formed with a needle clearance aperture 5 which has the shape of an hourglass, that is, which is provided with four distinct recesses 5A, 5B, 5C and 5D, arranged generally in the corners of a square pattern coorelated with the needle penetration locations during formation of the two successive tacks of stitches 150, 151 in the above described sequence of operation of the button sewing machine.

Figure 2:
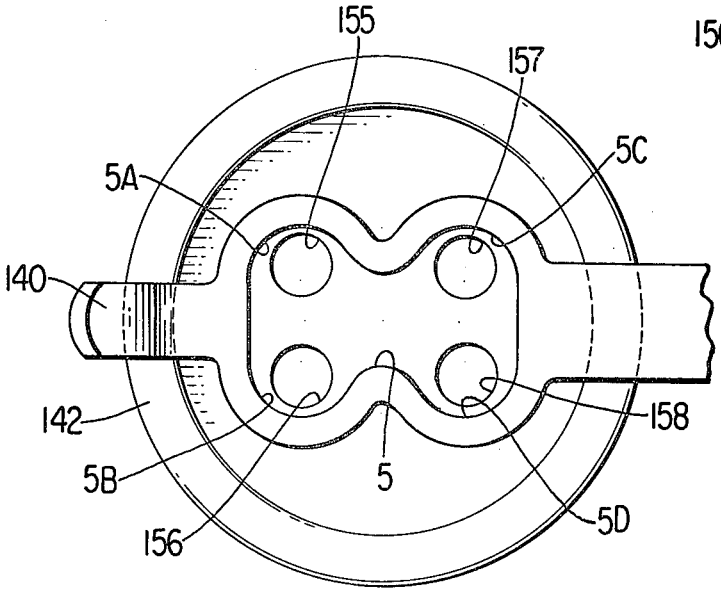
FIG. 2 is an enlarged top plan view of the button holding foot of FIG. 1 including representation of a four hole button properly oriented thereunder.

As best illustrated in FIG. 2, the formation of the recesses 5A, 5B, 5C and 5D conforms with the standard hole arrangement in four hole buttons so that when a button is placed beneath the foot 140, the proper hole orientation is graphically presented to the operator.

A machine having a button holding foot formed with a needle clearance aperture 5 can also be utilized to sew two hole buttons. When sewing two hole buttons, the button is oriented under the foot 140 with the two holes arranged in recesses 5C and 5D and the machine is operated to produce just a single zig zag tack of stitches 151.

I claim:

1. A work holding clamp for a four hole button sewing machine comprising superposed fabric gripping jaws and a button holding foot opposed to said superposed fabric gripping jaws for accommodating therebetween a four hole button in a variety of hole orientations, each of said fabric gripping jaws and said button holding foot being formed with a needle accomodating aperture, the needle accommodating aperture in said button holding foot being formed with an hourglass shape including four distinct recesses arranged generally in the corners of a square pattern conforming with the standard hole arrangement in four hole buttons whereby the needle accommodating aperture in said button holding foot presents a graphic indication to a machine operator of the proper hole orientation.

* * * * *